US012709858B2

(12) United States Patent
Michaud

(10) Patent No.: US 12,709,858 B2
(45) Date of Patent: Aug. 18, 2026

(54) PLANTABLE RETAINING WALL BLOCK AND RETAINING WALLS THEREOF

(71) Applicant: Cornerstone Wall Solutions Inc., Calgary (CA)

(72) Inventor: Alain Michaud, Calgary (CA)

(73) Assignee: Cornerstone Wall Solutions Inc., Calgary (CA)

( * ) Notice: Subject to any disclaimer, the term of this patent is extended or adjusted under 35 U.S.C. 154(b) by 32 days.

(21) Appl. No.: 18/843,066

(22) PCT Filed: Sep. 1, 2022

(86) PCT No.: PCT/CA2022/051322
§ 371 (c)(1),
(2) Date: Aug. 30, 2024

(87) PCT Pub. No.: WO2023/164757
PCT Pub. Date: Sep. 7, 2023

(65) Prior Publication Data

US 2025/0171979 A1 May 29, 2025

Related U.S. Application Data

(60) Provisional application No. 63/315,325, filed on Mar. 1, 2022.

(51) Int. Cl.
*E02D 29/02* (2006.01)

(52) U.S. Cl.
CPC ..... *E02D 29/0266* (2013.01); *E02D 29/025* (2013.01)

(58) Field of Classification Search
CPC ..... E02D 29/025; E02D 29/0266
See application file for complete search history.

(56) References Cited

U.S. PATENT DOCUMENTS 4,860,505 A * 8/1989 Bender ..... E02D 29/025 52/592.6
4,964,761 A * 10/1990 Rossi ..... E02D 29/025 405/286
5,108,231 A * 4/1992 Rausch ..... E01F 8/023 D25/113
5,163,261 A * 11/1992 O'Neill ..... E02D 29/0225 52/592.6
5,528,873 A * 6/1996 Correia ..... E04B 2/06 405/286
5,622,456 A * 4/1997 Risi ..... E02D 29/025 405/262
5,951,210 A * 9/1999 Maguire ..... E02D 29/0225 52/582.1
6,152,655 A * 11/2000 Hull ..... E04C 1/395 52/592.6

(Continued)

FOREIGN PATENT DOCUMENTS

CA 2281332 A1 7/2000
CA 3111429 A1 * 3/2020 ..... E02D 29/0266

(Continued)

*Primary Examiner* — Frederick L Lagman
(74) *Attorney, Agent, or Firm* — Haynes and Boone, LLP

(57) ABSTRACT

Disclosed herein is a plantable retaining wall block configurable in at least three different retaining wall configurations, including a plantable wall, a retaining wall and a free-standing wall.

21 Claims, 10 Drawing Sheets

(56) References Cited

U.S. PATENT DOCUMENTS

| | | | | |
|---|---|---|---|---|
| 6,715,965 | B2 * | 4/2004 | Manthei | E02D 29/025 405/262 |
| 7,059,808 | B2 * | 6/2006 | Risi | E04C 1/395 405/286 |
| 7,396,190 | B2 * | 7/2008 | Price | E04C 1/395 405/286 |
| 8,882,398 | B2 * | 11/2014 | Bender | E02D 29/025 405/286 |
| 9,453,341 | B1 * | 9/2016 | Swierad | E01F 8/0005 |
| 10,280,584 | B2 * | 5/2019 | Nicol | E02D 29/025 |
| 10,941,567 | B2 * | 3/2021 | Harris | E04B 2/46 |
| 2001/0029709 | A1 * | 10/2001 | Anderson | E02D 29/0233 47/33 |
| 2007/0166112 | A1 * | 7/2007 | Risi | E04C 1/39 405/284 |
| 2008/0244995 | A1 | 10/2008 | Kemp | |
| 2016/0369472 | A1 | 12/2016 | Ianello et al. | |
| 2018/0274229 | A1 * | 9/2018 | Burnquist | E04C 1/39 |

FOREIGN PATENT DOCUMENTS

| | | | | | |
|---|---|---|---|---|---|
| CN | 114150700 | A | * | 3/2022 | E02D 19/10 |
| CN | 114150813 | A | * | 3/2022 | E04C 1/00 |
| DE | 3025870 | A1 | | 2/1982 | |
| EP | 1741847 | A2 | * | 1/2007 | E02D 29/025 |
| EP | 2391775 | B1 | | 1/2013 | |
| KR | 200429718 | Y1 | | 10/2006 | |
| KR | 20110003195 | U | | 3/2011 | |
| KR | 101132200 | B1 | * | 4/2012 | A01K 61/00 |
| KR | 20180043764 | A | | 4/2018 | |
| KR | 102139448 | B1 | * | 7/2020 | E02D 29/025 |
| KR | 102273710 | B1 | | 7/2021 | |
| KR | 20210117768 | A | | 9/2021 | |
| KR | 200495163 | Y1 | * | 3/2022 | E02D 29/025 |

* cited by examiner

PLANTABLE RETAINING WALL BLOCK AND RETAINING WALLS THEREOF

CROSS-REFERENCE

This application is a U.S. National Stage Patent Application of International Patent Application No. PCT/CA2022/051322, filed on Sep. 1, 2022, which claims priority to and benefit of U.S. Patent Application Ser. No. 63/315,325 filed on Mar. 1, 2022, which are hereby incorporated by reference in their entirety.

TECHNICAL FIELD

The present disclosure generally relates to a plantable retaining wall block configurable in at least three different retaining wall configurations.

BACKGROUND

Retaining walls are commonly used for supporting soil at different levels on each side. A recent trend is for retaining walls to have a 'green' component, whereby the retaining wall includes a plantable portion, for example by a cavity internal to the retaining wall block that is capable of housing soil and thereby growing plants.

Various drawbacks arise in respect of such existing plantable retaining wall blocks, including limits on usage and retaining wall configurations, the need for additional connector or reinforcement members, the inability to shift between different retaining wall configurations on a single jobsite or landscaping project without using retaining wall blocks of different styles, and so forth.

There exists a need for an effective plantable retaining wall block that enables a retaining walls of multiple different configurations.

SUMMARY

The present disclosure provides plantable retaining wall blocks that are capable of multiple different retaining wall configurations.

In an embodiment, the present disclosure relates to a plantable retaining wall block comprising: a front side, a back side and sidewalls extending therebetween, each of the front side and the back side having an outwardly facing profile; a plantable cavity disposed between the front side and the back side, and open at a top side of the plantable retaining wall block; an upwardly extending ridge oriented parallel to the front side and back side, and extending upwards at a side of the plantable cavity proximal to the back side; at least three recesses in a bottom side of the plantable retaining wall block for receiving the upwardly extending ridge of at least one other of the plantable retaining wall blocks when assembled in a wall, wherein: when a first recess of the at least three recesses receives the upwardly extending ridge of the at least one other of the plantable retaining wall blocks oriented in the same front side facing direction, a plantable retaining wall is formed; when a second recess of the at least three recesses receives the upwardly extending ridge of the at least one other of the plantable retaining wall blocks oriented in a reverse front side facing direction, a free-standing wall is formed; and when a third recess of the at least three recesses receives the upwardly extending ridge of the at least one other of the plantable retaining wall blocks oriented in the same front side facing direction, a retaining wall is formed.

In an embodiment of the plantable retaining wall blocks herein, the outwardly facing profile of the front side and the back side is identical in dimensions of height and length.

In an embodiment of the plantable retaining wall blocks herein, the front side and the back side are identical in width.

In an embodiment of the plantable retaining wall blocks herein, when the plantable retaining wall is formed the plantable cavity of at least one other of the plantable retaining wall blocks is accessible for receiving planting materials.

In an embodiment of the plantable retaining wall blocks herein, when the free-standing wall is formed the plantable cavity of at least one other of the plantable retaining wall blocks is inaccessible and the front side and back side of the plantable retaining wall blocks in the free-standing wall are aligned to form a perpendicular wall.

In an embodiment of the plantable retaining wall blocks herein, when the retaining wall is formed the plantable cavity of at least one other of the plantable retaining wall blocks is inaccessible and each row of the plantable retaining wall blocks placed atop another row is set back in a direction towards the back side to form a slanted wall.

In an embodiment of the plantable retaining wall blocks herein, each of the sidewalls adjoin the front side at opposing longitudinal ends of the front side.

In an embodiment of the plantable retaining wall blocks herein, each of the sidewalls are angled inwards towards each other from the front side to the back side, and the sidewalls adjoin the back side at a distance inwards from each opposing longitudinal end of the back side. In an embodiment, the front side and sidewalls adjoin the back side in the shape of an isosceles trapezoid.

In an embodiment of the plantable retaining wall blocks herein, when the plantable retaining wall blocks are assembled side-by-side, the gap between the sidewalls of each of the plantable retaining wall blocks forms a secondary plantable cavity that is deeper than the plantable cavity of each plantable retaining wall block by providing an access opening to the plantable cavity of a lower row of plantable retaining wall blocks.

In an embodiment of the plantable retaining wall blocks herein, when the free-standing wall is formed, one or more or the plantable retaining wall blocks can be oriented in an opposite direction to other plantable retaining wall blocks on a given row to provide a planting pocket.

In an embodiment of the plantable retaining wall blocks herein, the outwardly facing profile has a height of between about 3 inches and about 12 inches and a length of between about 9 inches and about 18 inches. In an embodiment, the height is about 6 inches and the length is about 12 inches.

In an embodiment, the plantable retaining wall blocks of the present disclosure comprise three of the recesses in the bottom side. In an embodiment, the plantable retaining wall blocks are about 12 inches in width from the outwardly facing profile of the front side to the outwardly facing profile of the back side. In an embodiment, the first recess is between about 1.0 and about 2.0 inches from the outwardly facing profile of the front side; the second recess is between about 4.0 and about 5.0 inches from the outwardly facing profile of the front side; and the third recess is between about 7.0 and about 8.0 inches from the outwardly facing profile of the front side. In a particular embodiment, the first recess is about 1.62 inches from the outwardly facing profile of the front side; the second recess is about 4.37 inches from the outwardly facing profile of the front side; and the third recess is about 7.49 inches from the outwardly facing profile of the front side. In an embodiment, the upwardly extending ridge is between about 4.0 and about 5.0 inches from the outwardly facing profile of the back side. In a particular embodiment, the upwardly extending ridge is about 4.25 inches from the outwardly facing profile of the back side.

In an embodiment of the plantable retaining wall blocks herein, the upwardly extending ridge extends above the top of the front side and the back side a distance that is equivalent to the depth of the at least three recesses.

In an embodiment, the plantable retaining wall blocks of the present disclosure further comprise an irrigation groove parallel to the front side and back side, the irrigation groove at a side of the plantable cavity distal to the back side. In an embodiment, the irrigation groove forms a channel in the sidewalls of the plantable retaining wall block in which an irrigation system can reside to provide water to the plantable cavity.

In an embodiment, the plantable retaining wall blocks of the present disclosure further comprise at least one drainage hole within the plantable cavity. In an embodiment, the at least one drainage hole is two drainage holes on the bottom of the plantable cavity.

In an embodiment, the plantable retaining wall blocks of the present disclosure further comprise a passage channel open to the top side and the bottom side. In an embodiment, the passage channel is disposed between the back side and the upwardly extending ridge.

In an embodiment, the present disclosure relates to the use of the plantable retaining wall blocks disclosed herein for assembling a plantable retaining wall, a retaining wall, a free-standing wall, or a wall having any combination thereof.

In an embodiment, the present disclosure relates to a method of assembling a wall comprising a plantable wall, a retaining wall, a free-standing wall, or any combination thereof, the method comprising: stacking two or more of the plantable retaining wall blocks of the present disclosure atop each other such that: to form a portion of the wall having the plantable wall, the first recess of a first block of the two or more of the plantable retaining wall blocks receives the upwardly extending ridge of a second block of the two or more of the plantable retaining wall blocks, wherein the first block and the second block are oriented in the same front side facing direction; to form a portion of the wall having the retaining wall, the third recess of a first block of the two or more of the plantable retaining wall blocks receives the upwardly extending ridge of a second block of the two or more of the plantable retaining wall blocks, wherein the first block and the second block are oriented in the same front side facing direction; and/or to form a portion of the wall having the free-standing wall, the second recess of a first block of the two or more of the plantable retaining wall blocks receives the upwardly extending ridge of a second block of the two or more of the plantable retaining wall blocks, wherein the first block and the second block are oriented in a reverse front side facing direction.

BRIEF DESCRIPTION OF THE DRAWINGS

These and other features of the present disclosure will become more apparent in the following detailed description in which reference is made to the appended drawing. The appended drawing illustrates one or more embodiments of the present disclosure by way of example only and is not to be construed as limiting the scope of the present disclosure.

DETAILED DESCRIPTION

Figure 12:
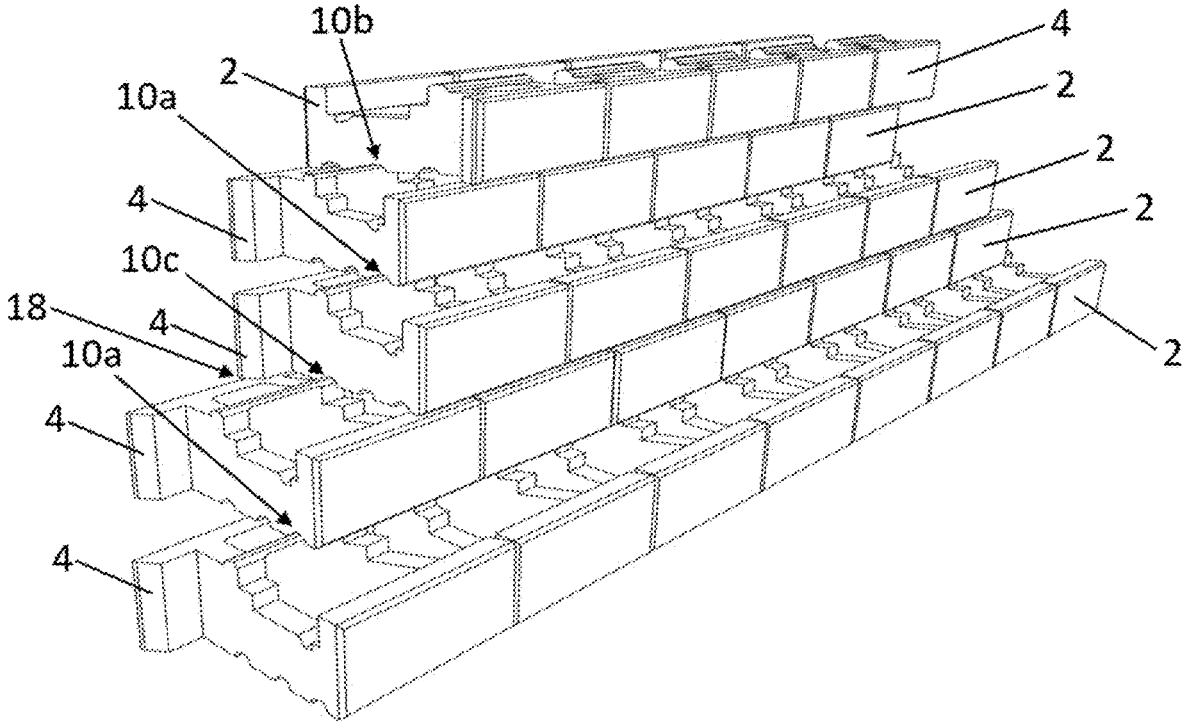
FIG. 12 is a front perspective view of the exemplary plantable retaining wall block of FIG. 1 shown assembled and stacked in a wall having a combined configuration from bottom to top of a plantable wall, a retaining wall, a plantable wall, and a free-standing wall.
Figure 13:
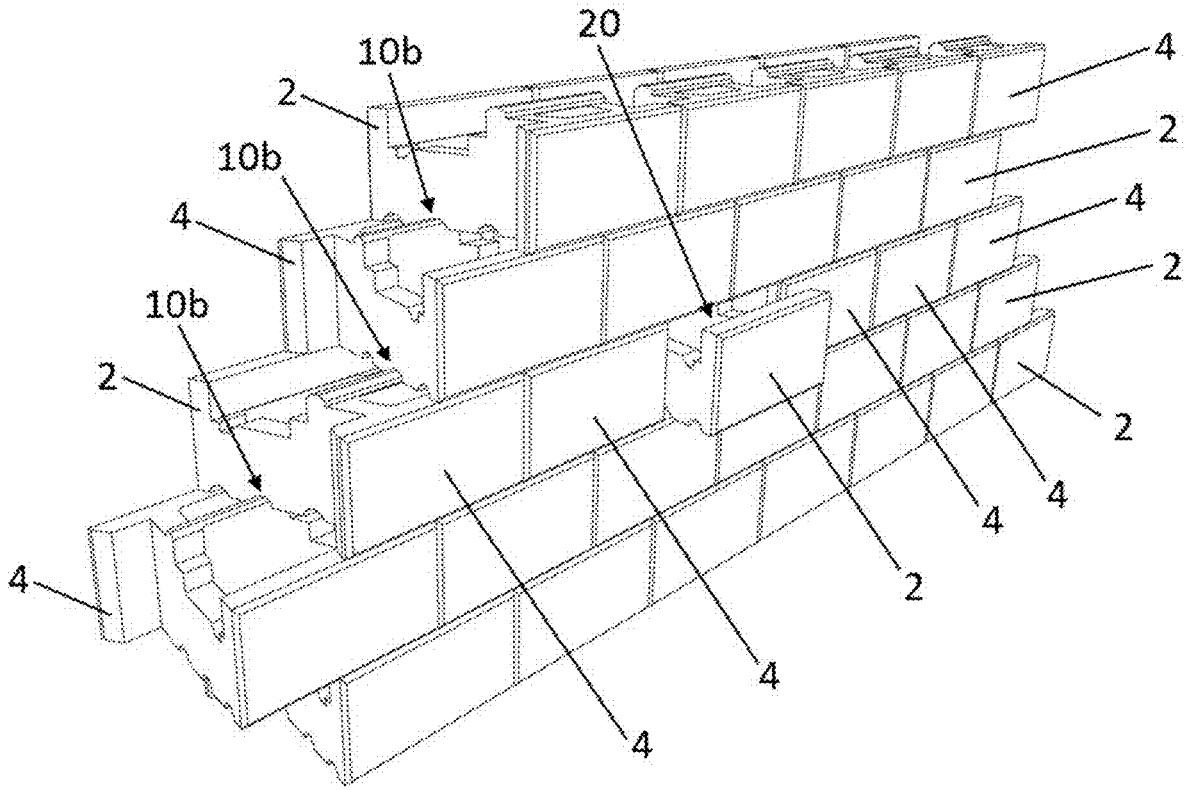
FIG. 13 is a front perspective view of the exemplary plantable retaining wall block of FIG. 1 shown assembled and stacked as a free-standing wall having a planter pocket.

The present disclosure provides a plantable retaining wall block (FIGS. 1-8) capable of at least three different wall configurations, and combinations thereof. For example as a plantable retaining wall (FIG. 9), a retaining wall (FIG. 10), a freestanding wall (FIG. 11), or a combination of all three configurations (FIG. 12). The plantable retaining wall blocks are also capable of providing planter pockets within a free-standing wall configuration (FIG. 13).

By the expression "plantable retaining wall block", it is intended to mean a retaining wall block having an area, cavity or region suitable for the planting and/or growth of plants or other vegetation.

As used herein, the expression "plantable retaining wall" is intended to refer to a retaining wall configured in a manner to provide an area or region for the planting and/or growth of plants or other vegetation. As used herein, the expression "retaining wall" has its ordinary meaning as a rigid wall used for supporting soil or other material on at least one side. Typically, a retaining wall may be slanted slightly as opposed to being perfectly perpendicular. As used herein, the expression "free-standing wall" is intended to refer to a perpendicular wall that while capable of supporting soil or other material on at least one side, it is also capable of standing freely without supporting material on either side.

The present disclosure provides plantable retaining wall blocks comprising improved design and features.

In an embodiment, the present disclosure relates to a plantable retaining wall block comprising: a front side, a back side and sidewalls extending therebetween, each of the front side and the back side having an outwardly facing profile; a plantable cavity disposed between the front side and the back side, and open at a top side of the plantable retaining wall block; an upwardly extending ridge oriented parallel to the front side and back side, and extending upwards at a side of the plantable cavity proximal to the back side; at least three recesses in a bottom side of the plantable retaining wall block for receiving the upwardly extending ridge of at least one other of the plantable retaining wall blocks when assembled in a wall, wherein: when a first recess of the at least three recesses receives the upwardly extending ridge of the at least one other of the plantable retaining wall blocks oriented in the same front side facing direction, a plantable retaining wall is formed; when a second recess of the at least three recesses receives the upwardly extending ridge of the at least one other of the plantable retaining wall blocks oriented in a reverse front side facing direction, a free-standing wall is formed; and when a third recess of the at least three recesses receives the upwardly extending ridge of the at least one other of the plantable retaining wall blocks oriented in the same front side facing direction, a retaining wall is formed.

In another embodiment, the present disclosure relates to the use of the plantable retaining wall blocks disclosed herein for assembling a plantable retaining wall, a retaining wall, a free-standing wall, or a wall having any combination thereof.

In an embodiment, the present disclosure relates to a method of assembling a wall comprising a plantable wall, a retaining wall, a free-standing wall, or any combination thereof, the method comprising: stacking two or more of the plantable retaining wall blocks of the present disclosure atop each other such that: to form a portion of the wall having the plantable wall, the first recess of a first block of the two or more of the plantable retaining wall blocks receives the upwardly extending ridge of a second block of the two or more of the plantable retaining wall blocks, wherein the first block and the second block are oriented in the same front side facing direction; to form a portion of the wall having the retaining wall, the third recess of a first block of the two or more of the plantable retaining wall blocks receives the upwardly extending ridge of a second block of the two or more of the plantable retaining wall blocks, wherein the first block and the second block are oriented in the same front side facing direction; and/or to form a portion of the wall having the free-standing wall, the second recess of a first block of the two or more of the plantable retaining wall blocks receives the upwardly extending ridge of a second block of the two or more of the plantable retaining wall blocks, wherein the first block and the second block are oriented in a reverse front side facing direction.

Reference will now be made in detail to exemplary embodiments of the present disclosure, wherein numerals refer to like components, examples of which are illustrated in the accompanying drawings that further show exemplary embodiments of the present disclosure, without limitation.

Figure 8:
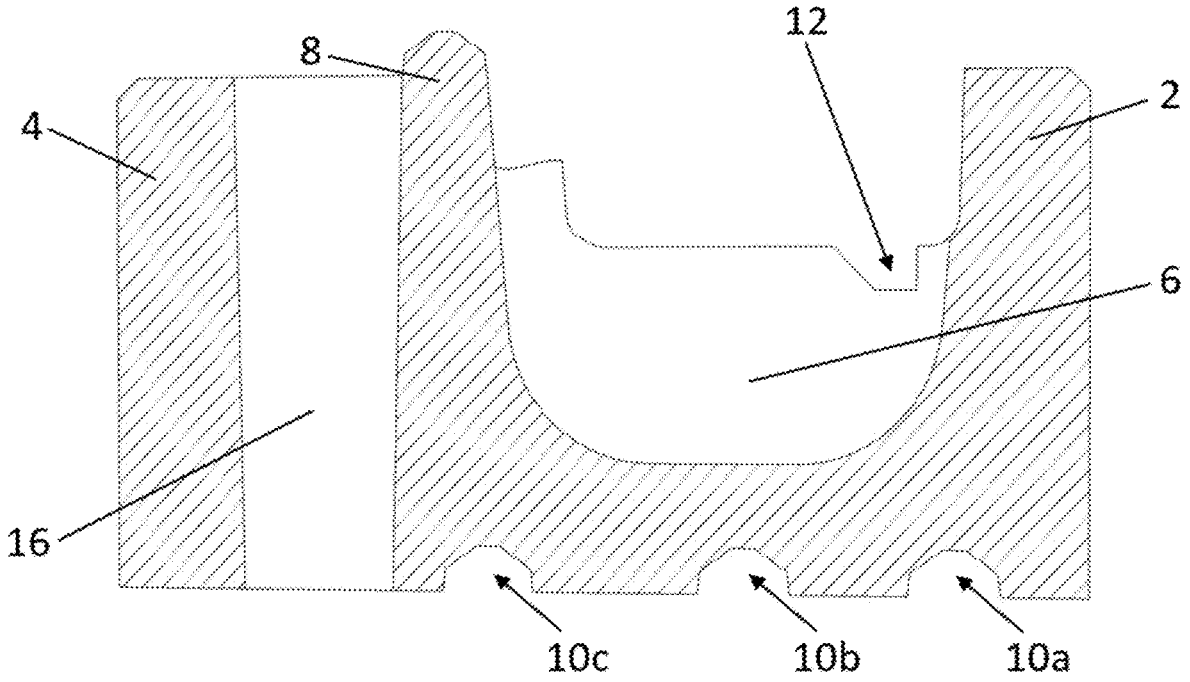
FIG. 8 is a cross-sectional view of the exemplary plantable retaining wall block of FIG. 1, taken along line 8-8 of FIG. 6.

FIGS. 1-8 show an exemplary plantable retaining wall block 1 of the present disclosure from various different angles (views), including in cross-section (FIG. 8).

In an embodiment, the plantable retaining wall block 1 comprises a front side 2 and a back side 4, and sidewalls (3, 5). As shown, the front side 2 and back side 4 are a generally rectangular structure running the longitudinal length of the plantable retaining wall block 1. Each of the front side 3 and back side 5 have an outwardly facing profile. By "outwardly facing profile", it is intended to mean the shape and size of the outwardly facing face of the front side 2 and back side 4. In an embodiment, the outwardly facing profile of the front side 2 and the back side 4 is identical in dimensions of height and length.

Figure 1:
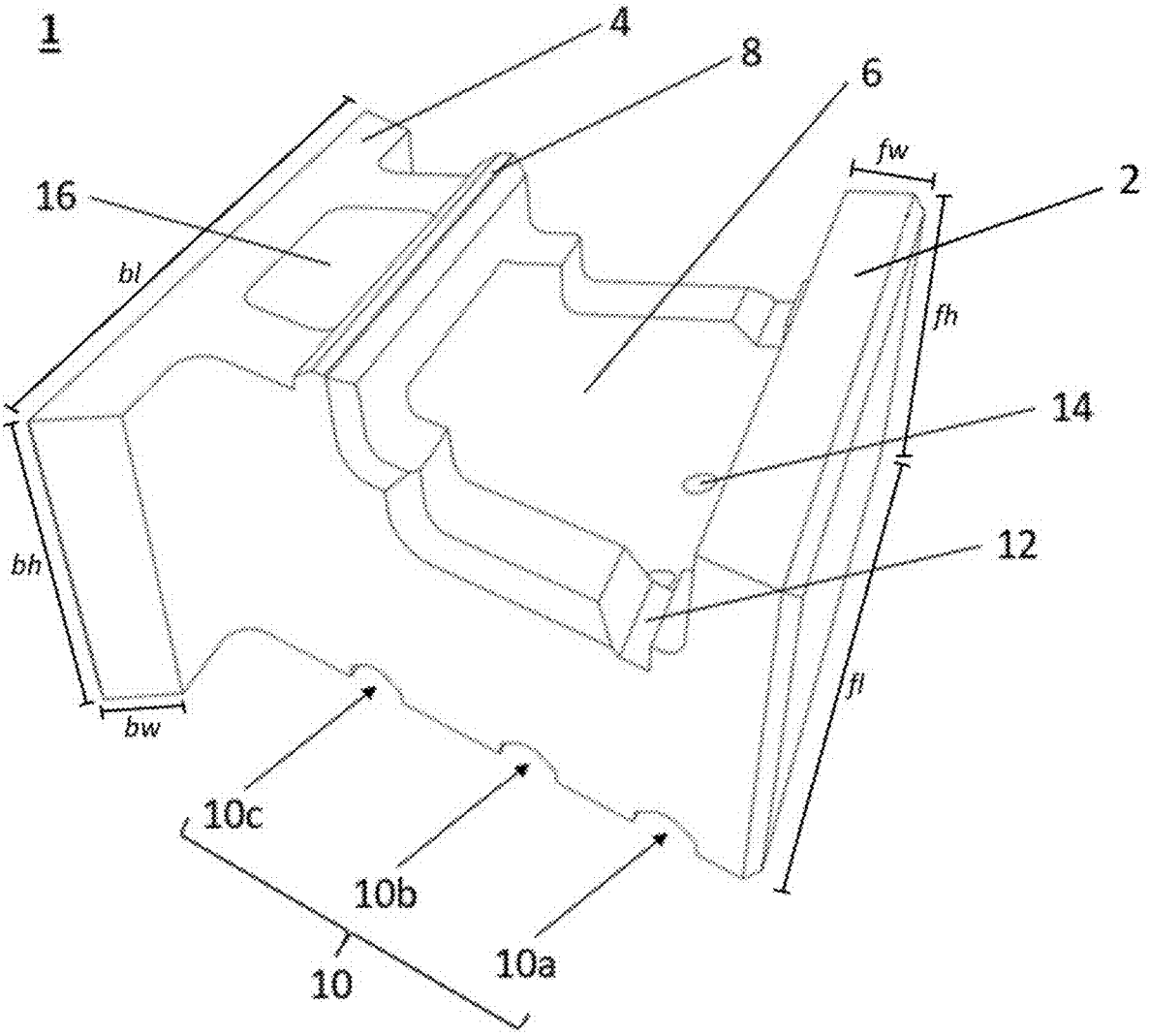
FIG. 1 is a perspective view of an exemplary plantable retaining wall block in accordance with the present disclosure.
Figure 2:
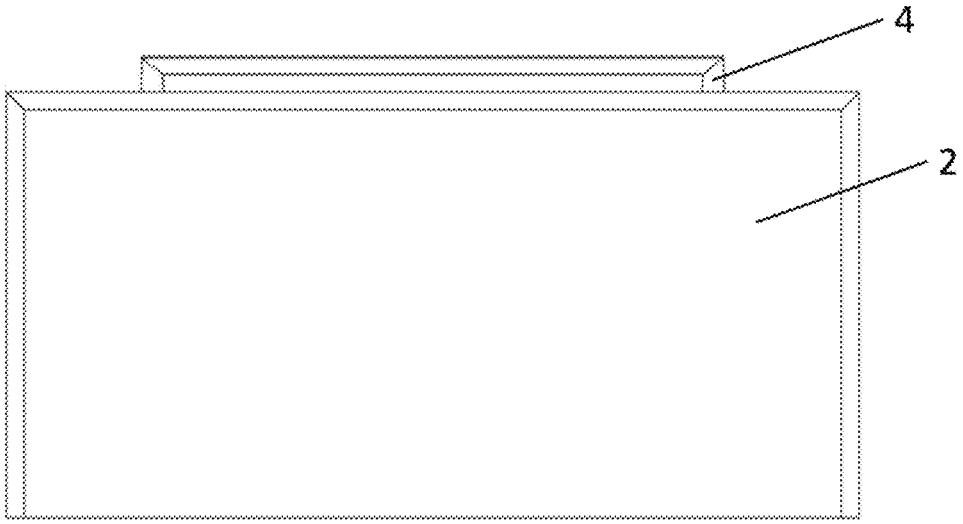
FIG. 2 is a front view of the exemplary plantable retaining wall block of FIG. 1.
Figure 3:
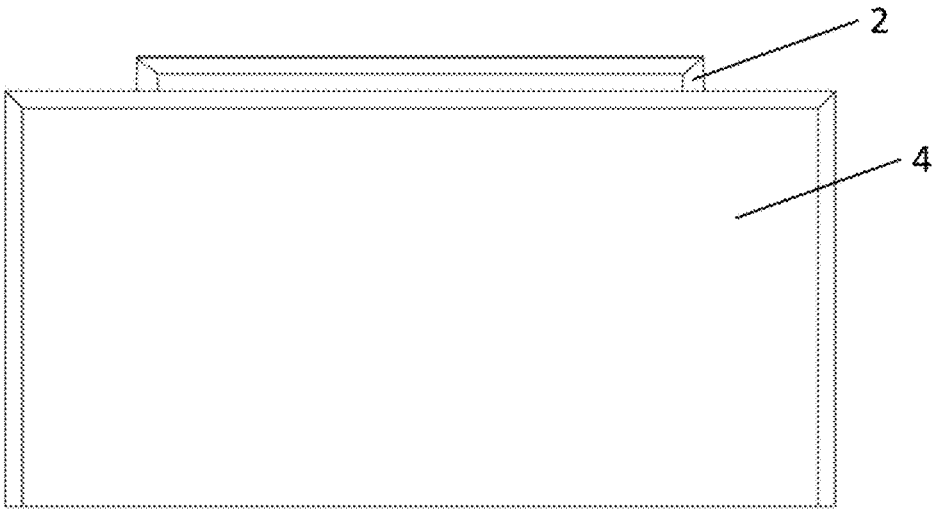
FIG. 3 is a back view of the exemplary plantable retaining wall block of FIG. 1.
Figure 4:
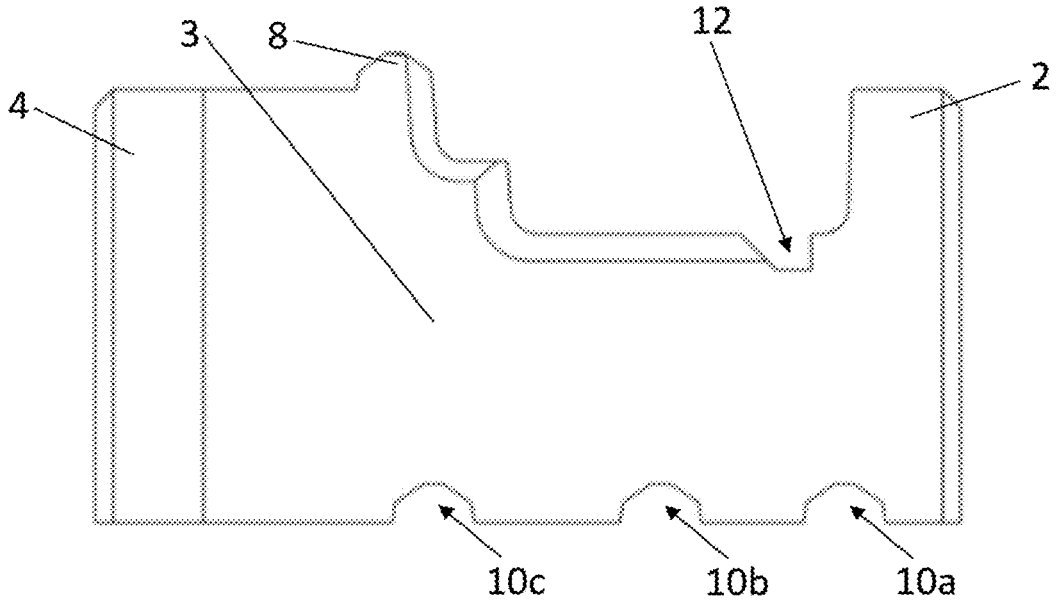
FIG. 4 is a left side view of the exemplary plantable retaining wall block of FIG. 1.
Figure 5:
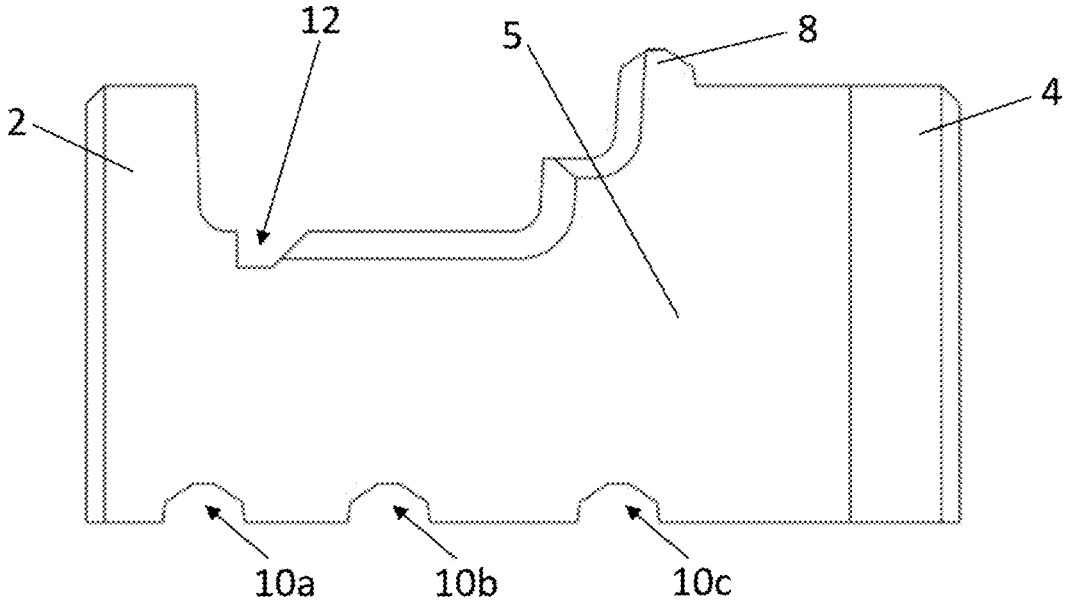
FIG. 5 is a right side view of the exemplary plantable retaining wall block of FIG. 1.

In FIG. 1, the front side 2 height and length are represented by fh and fl, respectively, and the back side 2 height and length are represented by bh and bl. In an embodiment, the outwardly facing profile has a height (fh, bh) of between about 3 inches and about 12 inches and a length (fl, bl) of between about 9 inches and about 18 inches. In an embodiment, the height (fh, bh) is about 3 inches, about 4 inches, about 5 inches, about 6 inches, about 7 inches, about 8 inches, about 9 inches, about 10 inches, about 11 inches or about 12 inches. In an embodiment, the length (fl, bl) is about 9 inches, about 10 inches, about 11 inches, about 12 inches, about 13 inches, about 14 inches, about 15 inches, about 16 inches, about 17 inches or about 18 inches. In a particular embodiment, the height (fh, bh) is about 6 inches and the length (fl, bl) is about 12 inches.

As further shown in FIG. 1, the front side 2 width and back side 4 width are represented by fw and fw, respectively. In an embodiment, the front side 2 and the back side 4 are identical in width.

Figure 6:
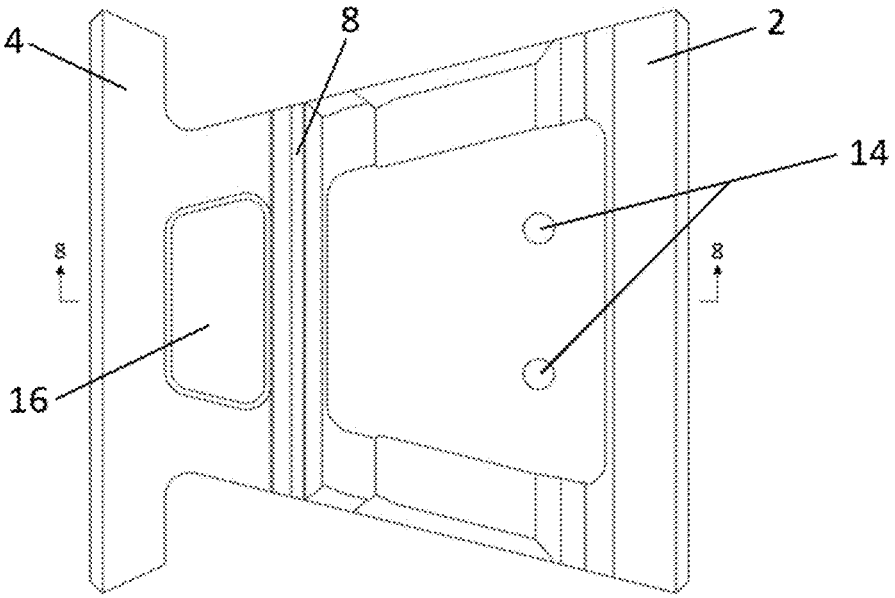
FIG. 6 is a top view of the exemplary plantable retaining wall block of FIG. 1.
Figure 7:
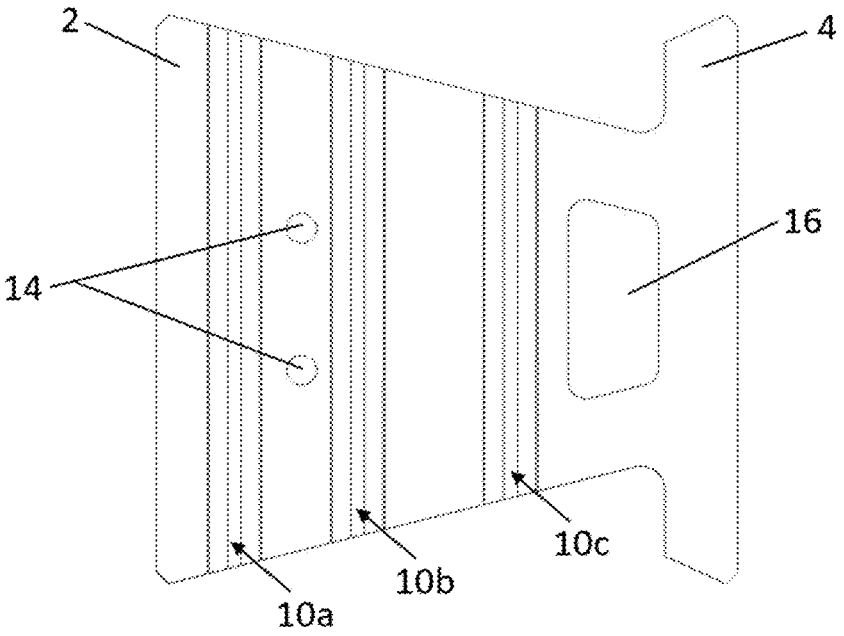
FIG. 7 is a bottom view of the exemplary plantable retaining wall block of FIG. 1.

The sidewalls (3, 5) adjoin the front side 2 and the back side 4. As used herein, by "adjoin" it is simply meant in contact with. The plantable retaining wall blocks 1 of the present disclosure would typically be of a monolithic structure. As shown in FIGS. 1-8, an exemplary configuration is for each of the sidewalls (3, 5) to adjoin the front side 2 at opposing longitudinal ends. Going from the front side 2 to the back side 2, the sidewalls (3, 5) may be angled inwards towards each other thereby adjoining to the back side 4 at a distance inwards from each opposing longitudinal end of the back side 4. As shown in FIG. 6, this imparts an isosceles trapezoid shape to the front side 2 and sidewalls (3, 5), with the back side 4 forming a table-top appearance. This is merely one exemplary configuration of the sidewalls (3, 5), and many other configurations may be used. Notably, in this configuration, when the plantable retaining wall blocks 1 are assembled side-by-side, the gap between the sidewalls (3, 5) of each of the plantable retaining wall blocks 1 forms a secondary plantable cavity 7 (FIG. 10) that is deeper than the plantable cavity 6 of each plantable retaining wall block 1 by providing an access opening to the plantable cavity 6 of a plantable retaining wall block 1 in the row below. This is an advantageous feature of the plantable retaining wall blocks 1 of the present disclosure in that it provides greater ability to grow plants with deeper roots.

Between the front side 2 and the back side 4 is disposed a plantable cavity 6 that is open at a top side of the plantable retaining wall block 1. The plantable cavity is for receiving soil and plant material (e.g. seeds, plants, e.g.) for the growth of plants. The plantable cavity may be of any suitable size having regarding to the dimensions of the plantable retaining wall block 1.

The shape of the plantable cavity 6 may be defined, in part, by the sidewalls (3, 5). As shown in the embodiment of FIGS. 1-8, the sidewalls (3, 5) are lower alongside the plantable cavity 6. Although in this exemplary configuration the depth of the plantable cavity 6 is reduced since the sidewalls (3, 5) are not as tall as they are alongside the passage channel 16, the reduced height dirt and soil to easily be spread from one adjacent plantable retaining wall block 1 to the next to create a plantable bed extending along the adjacent plantable retaining wall blocks 1. In other embodiments, the sidewalls (3, 5) alongside the plantable cavity 6 may be higher, for example to form individual cavities for plants.

The plantable retaining wall block 1 further comprises an upwardly extending ridge 8 oriented parallel to the front side 2 and back side 4, and which extends upwards at a side of the plantable cavity 6 proximal to the back side 4. By "parallel to the front side 2 and back side 4", it is meant that the upwardly extending ridge 8 is longitudinally oriented to run lengthwise along the plantable retaining wall block 1 in parallel to the length (fl, bl) of the front side 2 and back side 4.

As shown in the embodiment in FIGS. 1-8, the upwardly extending ridge 8 is located closer to the back side 4 of the plantable retaining wall block 1, between the back side 4 and the plantable cavity 6. In an embodiment, such as when the plantable retaining wall block 1 is about 12 inches in width from the outwardly facing profile of the front side 2 to the outwardly facing profile of the back side 4, the upwardly extending ridge 8 is between about 4.0 and about 5.0 inches from the outwardly facing profile of the back side 4. In a particular embodiment, the upwardly extending ridge 8 is about 4.25 inches from the outwardly facing profile of the back side 4. In other embodiments in which the width of the blocks is less than or greater than 12 inches, the skilled person would understand based on the disclosure herein how to position the upwardly extending ridge 8 to maintain proportionality.

The upwardly extending ridge 8 extends upwards to a height that is above the top surface of the front side 2 and back side 4. In this manner, when plantable retaining wall blocks 1 are placed atop each other, the bottom of the upper block rests on the top of the of the front side 2 and back side 4, with the upwardly extending ridge 8 received by one of the recesses 10 in the bottom. In an embodiment, the upwardly extending ridge extends above the top of the front side 2 and the back side 4 by a distance that is equivalent to the depth of the at least three recesses 10.

In this regard, the plantable retaining wall block 1 further comprises at least three recesses 10 (10*a*, 10*b*, 10*c*) in a bottom side for receiving the upwardly extending ridge 8 of at least one other of the plantable retaining wall block 1 when assembled in a wall. The different positions of each of the recesses 10 allow for the plantable retaining wall blocks 1 to be configured into at least three different types of retaining walls. The plantable retaining wall blocks 1 may be used to assemble a wall having a single configuration (e.g. as a plantable retaining wall, as a retaining wall, or as a free-standing wall). Alternatively, plantable retaining wall blocks 1 may be used to assemble a wall having a multiple configurations, including a combination of portions that are a plantable retaining wall, a retaining wall, and/or a free-standing wall.

Figure 9:
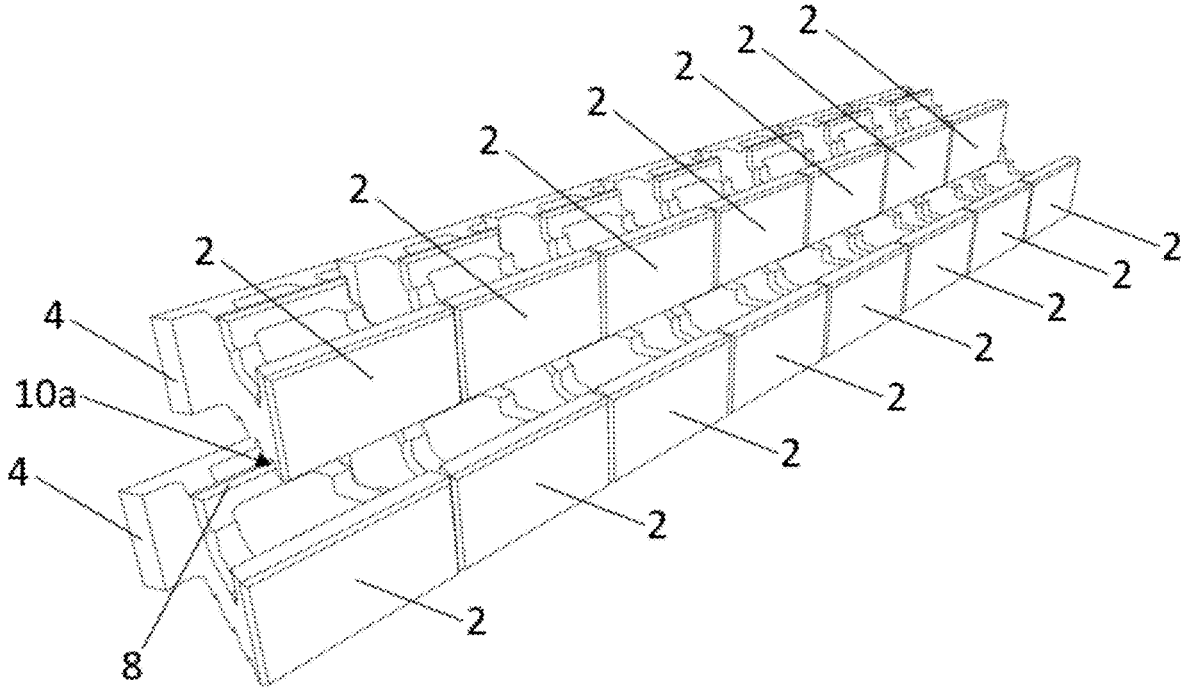
FIG. 9 is a front perspective view of the exemplary plantable retaining wall block of FIG. 1 shown assembled and stacked in a first configuration as a plantable wall.

For example, when a first recess 10*a* of the at least three recesses 10 receives the upwardly extending ridge 8 of at least one other of the plantable retaining wall blocks 1 oriented in the same front side facing direction, a plantable retaining wall is formed (FIG. 9). As shown in FIG. 9, of the at least three recesses 10, the first recess 10*a* is located the closest to the front side 2. Also, to expose the plantable cavity 6 within the lower row of the plantable retaining wall blocks 1, the plantable retaining wall blocks 1 of each row must be oriented with their front side 2 facing the same direction. This is referred to herein as "oriented in the same front side facing direction", meaning the plantable retaining wall blocks 1 are assembled with their front side 2 facing the same direction. In this plantable retaining wall configuration, the plantable cavity 6 within the lower row of the plantable retaining wall blocks 1 is accessible for receiving planting materials.

Figure 10:
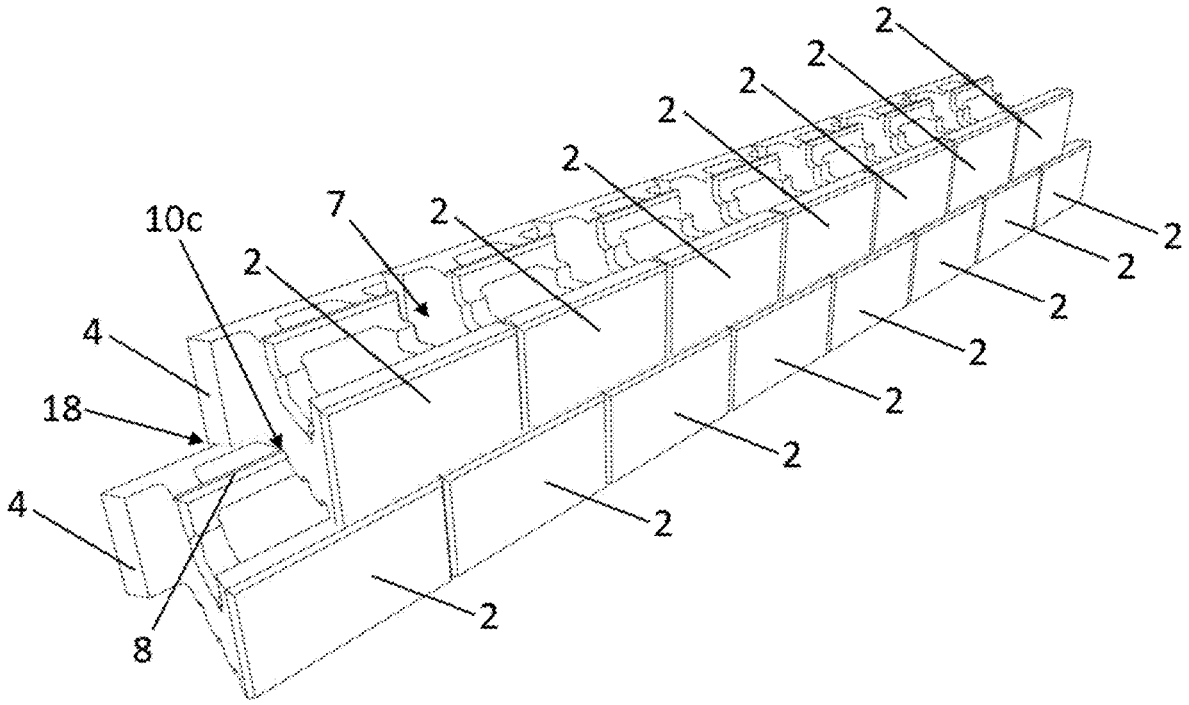
FIG. 10 is a front perspective view of the exemplary plantable retaining wall block of FIG. 1 shown assembled and stacked in a second configuration as a retaining wall.

In contrast, when a third recess 10*c* of the at least three recesses 10 receives the upwardly extending ridge 8 of the at least one other of the plantable retaining wall block 1 oriented in the same front side facing direction, a retaining wall is formed (FIG. 10). As shown in FIG. 10, of the at least three recesses 10, the third recess 10*c* is located the furthest away from the front side 2. Also, to render the plantable cavity 6 inaccessible in the lower row of the plantable retaining wall blocks 1 and thereby form the retaining wall, the plantable retaining wall blocks 1 of each row must be oriented with their front side 2 facing the same direction. As is further shown in the embodiment of FIG. 10, the row of the plantable retaining wall blocks 1 that is placed atop another row is set back in a direction towards the back side 4 to form a slanted wall. This is shown by the lip 18 extending outwards behind the top of the back side 4 of the lower row of plantable retaining wall blocks 1. Thus, as is typical of a retaining wall, the plantable retaining wall blocks 1 of the present disclosure allow the wall to slant backwards, e.g. against a soil support. In an embodiment, each successive upper row of the retaining wall shifts backwards by between about 0.5 inches and about 2.0 inches. In a particular embodiment, each successive upper row of the retaining wall shifts backwards by about 1.0 inch.

Figure 11:
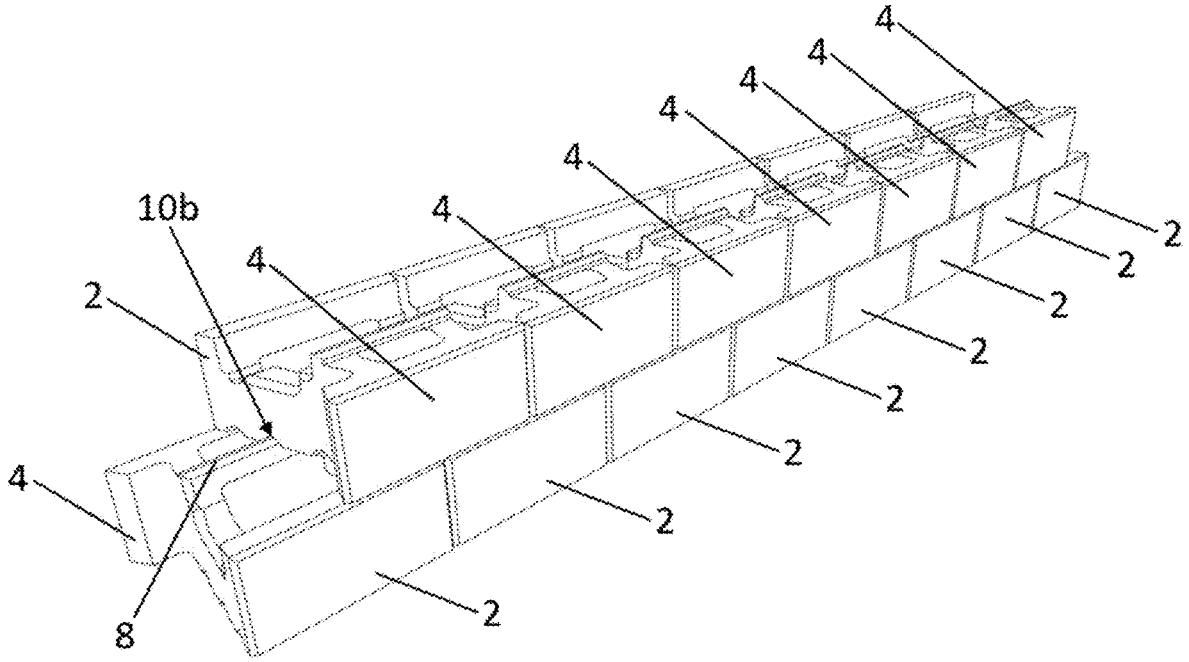
FIG. 11 is a front perspective view of the exemplary plantable retaining wall block of FIG. 1 shown assembled and stacked in a third configuration as a free-standing wall.

In contrast again, when a second recess 10*b* of the at least three recesses 10 receives the upwardly extending ridge 8 of at least one other of the plantable retaining wall blocks 1 oriented in a reverse front side facing direction, a free-standing wall is formed (FIG. 11). As shown in FIG. 11, of the at least three recesses 10, the second recess 10*b* is located in the middle. In order to achieve this configuration of a free-standing wall, the retaining wall blocks 1 are successively positioned atop each other in an opposite orientation whereby the back side 4 of the upper plantable retaining wall block 1 sits atop the front side 2 of the lower retaining wall block, or vice versa. This is referred to herein as "oriented in a reverse front side facing direction", meaning the plantable retaining wall blocks 1 are assembled atop each other with their front side 2 facing the opposite direction. To form a free-standing wall having multiple rows of retaining wall blocks 1, each row will alternate in orientation. In this free-standing wall configuration, the plantable cavity 6 within the lower row of the plantable retaining wall blocks 1 is inaccessible for receiving planting materials. Also, in contrast to the slanted embodiments of the retaining wall configuration, the plantable retaining wall blocks 1 of the free-standing wall are aligned to form a perpendicular wall (not slanted).

In addition to the exemplary walls shown in FIGS. 9-11 which show a single configuration as either a plantable retaining wall (FIG. 9), a retaining wall (FIG. 10), or a free-standing wall (FIG. 11), the plantable retaining wall blocks of the present disclosure are also capable of assembling walls having a combination of configurations within a single wall.

Merely by way of example, and without limitation, FIG. 12 shows a wall having all three configurations. The bottom row is configured as a plantable retaining wall with the upwardly extending ridge 8 being received by recess 10*a* of the plantable retaining wall blocks 1 in the row above. The second row from the bottom is configured as a retaining wall with the upwardly extending ridge 8 being received by recess 10*c* of the plantable retaining wall blocks 1 in the row above. The third row from the bottom is configured as a plantable retaining wall with the upwardly extending ridge 8 being received by recess 10*a* of the plantable retaining wall blocks 1 in the row above. The fourth row from the bottom is configured as a free-standing wall with the upwardly extending ridge 8 being received by recess 10*b* of the plantable retaining wall blocks 1 in the row above (oriented in a reverse front side facing direction).

In other exemplary embodiments, one or more plantable retaining wall blocks 1 in any given row may be configured to protrude outwards, such as to form a planter pocket 20 as shown in FIG. 13. In FIG. 13, the plantable retaining wall block 1 that forms the planter pocket 20 is configured in a plantable retaining wall configuration with the plantable retaining wall blocks 1 in the row above, whereas all of the other plantable retaining wall blocks 1 in the wall are in a free-standing wall configuration. Alternatively, one or more plantable retaining wall blocks 1 in any given row may be recessed inwards as compared to others (not shown). For example, referring to FIG. 12, it is possible for one or more of the plantable retaining wall blocks 1 in the third row from the bottom to be positioned under the row above in a retaining wall configuration. Thus, even within a given row, the plantable retaining wall blocks 1 of the present disclosure allow for different configurations.

As shown in the embodiment in FIGS. 1-8, the plantable retaining wall blocks 1 have three recesses 10 (10*a*, 10*b*, 10*c*). In an embodiment, such as when the plantable retaining wall block 1 is about 12 inches in width from the outwardly facing profile of the front side 2 to the outwardly facing profile of the back side 4, the first recess 10*a* is between about 1.0 and about 2.0 inches from the outwardly facing profile of the front side 2; the second recess 10*b* is between about 4.0 and about 5.0 inches from the outwardly facing profile of the front side 2; and the third recess 10*c* is between about 7.0 and about 8.0 inches from the outwardly facing profile of the front side 2. In a particular embodiment, the first recess 10*a* is about 1.62 inches from the outwardly facing profile of the front side 2; the second recess 10*b* is about 4.37 inches from the outwardly facing profile of the front side 2; and the third recess 10*c* is about 7.49 inches from the outwardly facing profile of the front side 2. In other embodiments in which the width of the plantable retaining wall blocks 1 is less than or greater than 12 inches, the skilled person would understand based on the disclosure herein how to position the recesses 10 to maintain proportionality.

As will be recognized by the skilled person, the recesses 10 herein are equally capable of being outwardly extending ridges and the upwardly extending ridge 8 is equally capable of being a recess. Other configurations may also be possible.

As shown in FIGS. 1-8, the plantable retaining wall block 1 of the present disclosure may further comprise an irrigation groove 12. In an embodiment, the irrigation groove 12 is parallel to the front side 2 and back side 4, and the irrigation groove 12 is at a side of the plantable cavity 6 distal to the back side 4. In an embodiment, the irrigation groove 12 forms a channel in the sidewalls (3, 5) of the plantable retaining wall block 1 in which an irrigation system can reside to provide water to the plantable cavity 6.

As shown in FIGS. 1-8, the plantable retaining wall block 1 of the present disclosure may further comprise at least one drainage hole 14 within the plantable cavity 6. In an embodiment, the at least one drainage hole is two drainage holes on the bottom of the plantable cavity 6. The plantable retaining wall block 1 may comprise any number of drainage holes 14, including 1, 2, 3, 4, 5, 6, 7, 8, 9, 10 or more.

As shown in FIGS. 1-8, the plantable retaining wall block 1 of the present disclosure may further comprise a passage channel 16 open to the top side and the bottom side. In an embodiment, the passage channel 16 is disposed between the back side 4 and the upwardly extending ridge 8. The passage channel 16 may, for example, be used as a passageway for structural components for retaining the wall in place or for delivery of materials into the retaining wall structures.

The plantable retaining wall block 1 of the present disclosure may further comprise one or more lights, such as grow lights for supporting the growth of plants contained therein and/or for ambiance lighting. The one or more lights may be mounted or positioned in any suitable location.

In another embodiment, the present disclosure relates to the use of the plantable retaining wall blocks 1 disclosed herein for assembling a wall, such as a plantable retaining wall, a retaining wall, a free-standing wall, or a wall having any combination thereof In another embodiment, the present disclosure relates to a method of assembling a wall comprising a plantable wall, a retaining wall, a free-standing wall, or any combination thereof, the method comprising: stacking two or more of the plantable retaining wall blocks 1 of the present disclosure atop each other such that: to form a portion of the wall having the plantable wall, the first recess 10*a* of a first block of the two or more of the plantable retaining wall blocks receives the upwardly extending ridge 8 of a second block of the two or more of the plantable retaining wall blocks, wherein the first block and the second block are oriented in the same front side facing direction; to form a portion of the wall having the retaining wall, the third recess 10*c* of a first block of the two or more of the plantable retaining wall blocks receives the upwardly extending ridge 8 of a second block of the two or more of the plantable retaining wall blocks, wherein the first block and the second block are oriented in the same front side facing direction; and/or to form a portion of the wall having the free-standing wall, the second recess 10*b* of a first block of the two or more of the plantable retaining wall blocks receives the upwardly extending ridge 8 of a second block of the two or more of the plantable retaining wall blocks, wherein the first block and the second block are oriented in a reverse front side facing direction.

In the present disclosure, all terms referred to in singular form are meant to encompass plural forms of the same. Likewise, all terms referred to in plural form are meant to encompass singular forms of the same. Unless defined otherwise, all technical and scientific terms used herein have the same meaning as commonly understood by one of ordinary skill in the art to which this disclosure pertains.

As used herein, the term "about" refers to an approximately +/−10% variation from a given value. It is to be understood that such a variation is always included in any given value provided herein, whether or not it is specifically referred to.

It should be understood that the compositions and methods are described in terms of "comprising," "containing," or "including" various components or steps, the compositions and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Although individual embodiments are discussed, the disclosure covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

Many obvious variations of the embodiments set out herein will suggest themselves to those skilled in the art in light of the present disclosure. Such obvious variations are within the full intended scope of the appended claims.

The invention claimed is:

1. A plantable retaining wall block comprising:

a front side, a back side and sidewalls extending therebetween, each of the front side and the back side having an outwardly facing profile;

a plantable cavity disposed between the front side and the back side, and open at a top side of the plantable retaining wall block;

an upwardly extending ridge oriented parallel to the front side and back side, and extending upwards at a side of the plantable cavity proximal to the back side;

at least three recesses in a bottom side of the plantable retaining wall block for receiving the upwardly extending ridge of at least one other of the plantable retaining wall blocks when assembled in a wall, wherein:

when a first recess of the at least three recesses receives the upwardly extending ridge of the at least one other of the plantable retaining wall blocks oriented in the same front side facing direction, a plantable retaining wall is formed;

when a second recess of the at least three recesses receives the upwardly extending ridge of the at least one other of the plantable retaining wall blocks oriented in a reverse front side facing direction, a free-standing wall is formed;

when a third recess of the at least three recesses receives the upwardly extending ridge of the at least one other of the plantable retaining wall blocks oriented in the same front side facing direction, a retaining wall is formed; and when the free-standing wall is formed the plantable cavity of the at least one other of the plantable retaining wall blocks is inaccessible and the front side and back side of the plantable retaining wall blocks in the free-standing wall are aligned to form a perpendicular wall.

2. The plantable retaining wall block of claim 1, wherein the outwardly facing profile of the front side and the back side is identical in dimensions of height and length.

3. The plantable retaining wall block of claim 2, wherein the front side and the back side are further identical in width.

4. The plantable retaining wall block of claim 1, wherein when the plantable retaining wall is formed the plantable cavity of the at least one other of the plantable retaining wall blocks is accessible for receiving planting materials.

5. The plantable retaining wall block of claim 1, wherein when the retaining wall is formed the plantable cavity of the at least one other of the plantable retaining wall blocks is inaccessible and each row of the plantable retaining wall blocks placed atop another row is set back in a direction towards the back side to form a slanted wall.

6. The plantable retaining wall block of claim 1, wherein each of the sidewalls adjoin the front side at opposing longitudinal ends of the front side.

7. The plantable retaining wall block of claim 1, wherein each of the sidewalls are angled inwards towards each other from the front side to the back side, and the sidewalls adjoin the back side at a distance inwards from each opposing longitudinal end of the back side.

8. The plantable retaining wall block of claim 7, wherein the front side and sidewalls adjoin the back side in the shape of an isosceles trapezoid.

9. The plantable retaining wall block of claim 7, wherein when the plantable retaining wall blocks are assembled side-by-side, the gap between the sidewalls of each of the plantable retaining wall blocks forms a secondary plantable cavity that is deeper than the plantable cavity of each plantable retaining wall block by providing an access opening to the plantable cavity of a lower row of plantable retaining wall blocks.

10. The plantable retaining wall block of claim 1, wherein when the free-standing wall is formed, one or more or the plantable retaining wall blocks can be oriented in an opposite direction to other plantable retaining wall blocks on a given row to provide a planting pocket.

11. The plantable retaining wall block of claim 1, wherein the outwardly facing profile has a height of between about 3 inches and about 12 inches and a length of between about 9 inches and about 18 inches.

12. The plantable retaining wall block of claim 11, wherein the height is about 6 inches and the length is about 12 inches.

13. The plantable retaining wall block of claim 1, which comprises three of the recesses in the bottom side.

14. The plantable retaining wall block of claim 13, wherein the block has about 12 inches in width from the outwardly facing profile of the front side to the outwardly facing profile of the back side.

15. The plantable retaining wall block of claim 14, wherein:

the first recess is between about 1.0 and about 2.0 inches from the outwardly facing profile of the front side;

the second recess is between about 4.0 and about 5.0 inches from the outwardly facing profile of the front side; and the third recess is between about 7.0 and about 8.0 inches from the outwardly facing profile of the front side.

16. The plantable retaining wall block of claim 15, wherein the upwardly extending ridge is between about 4.0 and about 5.0 inches from the outwardly facing profile of the back side.

17. The plantable retaining wall block of claim 1, wherein the upwardly extending ridge extends above the top of the front side and the back side by a distance that is equivalent to the depth of the at least three recesses.

18. The plantable retaining wall block of claim 1, further comprising an irrigation groove parallel to the front side and back side, the irrigation groove at a side of the plantable cavity distal to the back side.

19. The plantable retaining wall block of claim 18, wherein the irrigation groove forms a channel in the sidewalls of the plantable retaining wall block in which an irrigation system can reside to provide water to the plantable cavity.

20. The plantable retaining wall block of claim 1, further comprising at least one drainage hole within the plantable cavity.

21. The plantable retaining wall block of claim 1, comprising a passage channel open to the top side and the bottom side, wherein the passage channel is disposed between the back side and the upwardly extending ridge.

* * * * *